US007214912B1

(12) United States Patent
Suszczynski

(10) Patent No.: US 7,214,912 B1
(45) Date of Patent: May 8, 2007

(54) INSTALLATION METHOD AND MATERIAL SYSTEM FOR INDUCTIVE BILLET HEATING COILS

(75) Inventor: Ted Suszczynski, Boardman, OH (US)

(73) Assignees: Christine P. Suszczynski, Boardman, OH (US); Michael P. Suszczynski, Boardman, OH (US); Maria Suszczynski, Oceanside, CA (US)

( * ) Notice: Subject to any disclaimer, the term of this patent is extended or adjusted under 35 U.S.C. 154(b) by 1 day.

(21) Appl. No.: 11/205,842

(22) Filed: Aug. 18, 2005

(51) Int. Cl.
*H05B 6/36* (2006.01)

(52) U.S. Cl. ..... 219/672; 219/674

(58) Field of Classification Search ..... 219/672, 219/673, 674, 675, 676, 677; 336/61, 57, 336/58, 55
See application file for complete search history.

(56) References Cited

U.S. PATENT DOCUMENTS 3,791,906 A * 2/1974 Farkas ..... 156/245
3,993,529 A * 11/1976 Farkas ..... 156/380.7
4,241,843 A 12/1980 Walker et al.
4,313,400 A 2/1982 Walker et al.
4,376,904 A * 3/1983 Horrigan ..... 310/208
4,400,226 A * 8/1983 Horrigan ..... 156/56
5,416,373 A * 5/1995 Maruyama et al. ..... 310/208
6,727,483 B2 * 4/2004 Thomas et al. ..... 219/632
6,730,893 B1 5/2004 Runde
7,049,563 B2 * 5/2006 Keishima et al. ..... 219/620
2003/0038130 A1 * 2/2003 Thomas et al. ..... 219/632

* cited by examiner

*Primary Examiner*—Daniel Robinson
(74) *Attorney, Agent, or Firm*—Harpman & Harpman

(57) ABSTRACT

An insulation application and replacement system method for use on electric induction heating coils used to heat billets in industrial applications. Re-lining induction coil heating devices with non-hazardous materials of the invention uses a multiple step process of removing existing hazardous installation materials and replacing with multiple layers of environmental and user safe glass cloth material treated with suspended refractory material in a carrier solution.

12 Claims, 3 Drawing Sheets

INSTALLATION METHOD AND MATERIAL SYSTEM FOR INDUCTIVE BILLET HEATING COILS

BACKGROUND OF THE INVENTION

1. Technical Field

This invention relates to electric induction heating coils for heating metal billets that provide "high" point of use temperature within a limited area. Such induction heating coils require that the conductive coil "winding" be surrounded with a water cooled corresponding coil and an insulation layer to keep the "winding" at the desired operational temperature.

2. Description of Prior Art

Prior art insulation applications heretofore use the best available high temperature resistant insulation materials having the physical properties required for relative thin layer shaped conforming applications, such as asbestos. As has been well documented, asbestos mineral fibers are hazardous when they become friable, inhaled or exposed to the human organism. Insulation lining of vessels is well known, see U.S. Pat. Nos. 4,241,843 and 4,313,400 as well as novel induction heating apparatus coils, see U.S. Pat. No. 6,730,893 which illustrates prior art induction heating coils in which a magnetic field is generated by the coil and passes through the object to be heated. Prior art induction coil isolation insulation is used to protect the inductive coil, (winding) from the high temperatures induced in the metal billet during the heating cycle and contact with a conductive liner. Aluminum billets which are typically extruded offer operational challenges due to the low conductivity values associated with non-ferrous metals. Given that asbestos insulating liners of the coil surface has been the standard, the required replacement with less performing material has been the only option such as glass cloth. Such replacement materials have a shortened effective operational life especially in the so-called "gap" formed by the typical stainless steal induction coil liner which cannot be continuous in this electro-magnetic environment. The gap in the stainless steel liner becomes a critical failure point of new replacement materials and thus, as noted, shortens the overall usefulness and service life of the insulation before replacement. Such insulation within the gap becomes burned, brittle and fractured during use and must be replaced or the liner will short out the coil and fail.

SUMMARY OF THE INVENTION

The present invention deals with the replacement of electrically non-conductive thermal resistant insulation lining of electro-magnetic induction heating coils used to reheat metal billets for processing. The method of the system uses refractory coating and embedded of the fiberglass glass cloth to form a continuous insulation barrier between the induction coil stainless steel liner and the surface of the induction coil itself. Multiple method steps define the relining or initial lining of the coil as well as ongoing service method steps for replacing critical gap sealant material used to increase the service life of the insulation in the coil.

DETAILED DESCRIPTION OF THE INVENTION

Figure 1:
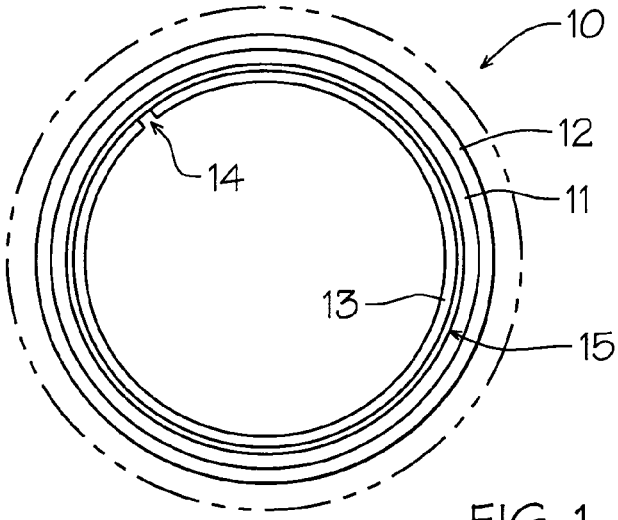
FIG. 1 illustrates an induction heating coil representation for illustration purposes.

Referring to FIG. 1 of the drawings, an induction heating coil 10 can be seen for illustration purposes that is used in the industry for rapid selective heating of metal billets positioned within. The basic components of the induction coil 10 are an electric conductive coil 11 in communication with a source of electrical power surrounded on its outer side by a corresponding water cooling coil 12. A stainless steel coil liner 13 extends the interior length of the induction coil 10 through which billets to be heated are transported. Such electro-magnetic induction heating coils are well known and widely used on the industry and further explanation is not required for the enabling disclosure of this invention which is directed to insulation liners (not shown) used to protect the coil 11 from high temperatures generated within the billet during induction heating typically 1000 degrees Fahrenheit.

Such insulation lining material heretofore was made from mineral asbestos due to its high temperature performance and useful life characteristics. Asbestos has been found to be hazardous to human health especially when it breaks down and becomes friable in which "micro-fibers" are released into the air or when it comes in contact with the human skin. This invention is therefore directed to a method and material application for replacing asbestos materials used as well as the insulation lining of new induction coil heating coils 10.

Figure 2:
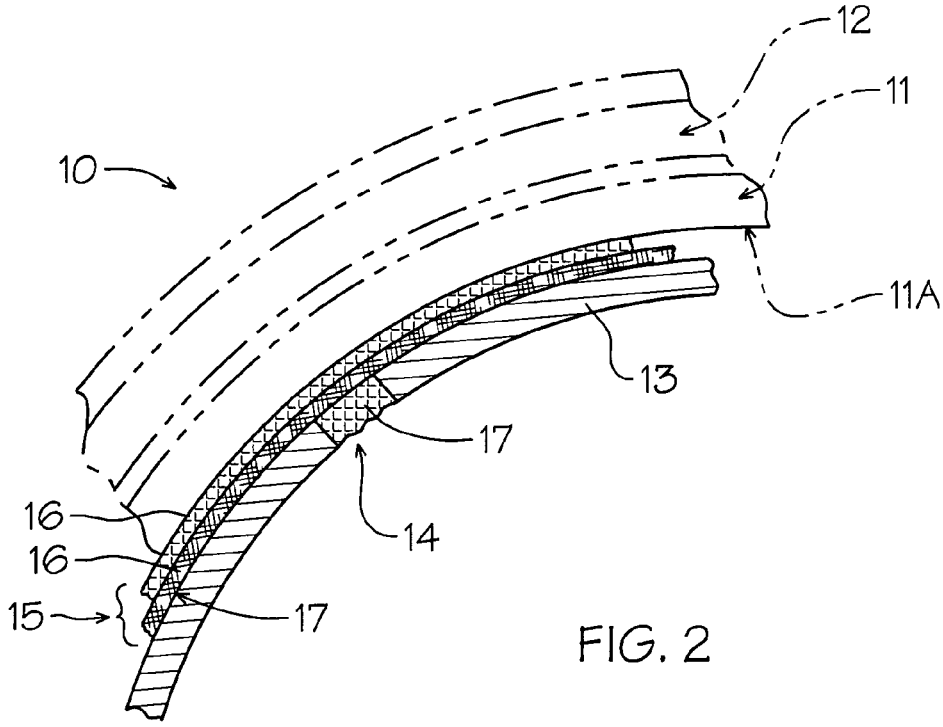
FIG. 2 is an enlarged cross-sectional view of the critical non-conductive gap in the steel liner which requires special insulation application.

Referring now to FIGS. 1 & 2 of the drawings, the stainless steel coil liner 13 can be seen (enlarged and simplified for illustration and understanding) having a required non-conductive elongated gap at 14. The gap area 14 is a critical point of prior art liner failure as will be described in greater detail hereinafter.

The method steps of the invention require that the stainless steel liner 13 be removed by conventional means for access to the interior surface of the coil 11. The stainless steel liner 13 is somewhat resilient and can therefore be compressed annularly slightly for removal and reinsertion. Any existing traditional lining material is removed presenting a clean inner surface 11A of the conductive coil 11. An insulating lining system 15 of the invention is then applied, first to the inner surface 11A of the coil 11. Sheets of fiberglass glass cloth 16 are positioned in place and coated or pre-coated with a high temperature refractory material 17 such as Noxtab brand manufactured by the Noc & Sons Company of Cleveland, Ohio. The refractory coating material 17 is in a semi-liquid based suspension for application purposes and will penetrate the glass cloth 16 to form an integral bond thereto within the textured surface of the glass cloth 16. As the refractory coating 17 dries, it becomes hard and takes on its high temperature resistance properties. Multiple layers of impregnated glass cloth 16 can be used depending on the application required.

Once the refractory coating material 17 has dried, in this application, the stainless steel coil liner 13 is reinserted using the normal installation techniques re-engaging the refractory surface 17 of the treated glass cloth 16. The gap area 14 defined by the stainless liner 13 is required as a non-electrically conductive break in the liner in all applications, as noted.

Since the elongated exposed area of the insulation within the gap area 14 is subject to the direct harsh environment of the billet chamber formed by the coil 11 a second layer of refractory coating material 17 is applied directly into the gap area. It will be seen that over time the gap area 14 may become degraded and it will therefore be a simple matter to simply reapply the refractory coating material 17 into the gap area 14 when needed. It will also be seen that given the insulating properties of the refractory coated 17 glass cloth liner 16, it will provide adequate protection even if the additional refractory coating material 17 is not applied to the gap area 14, just a shortened lifespan than the full application method described hereinabove.

Figure 3:
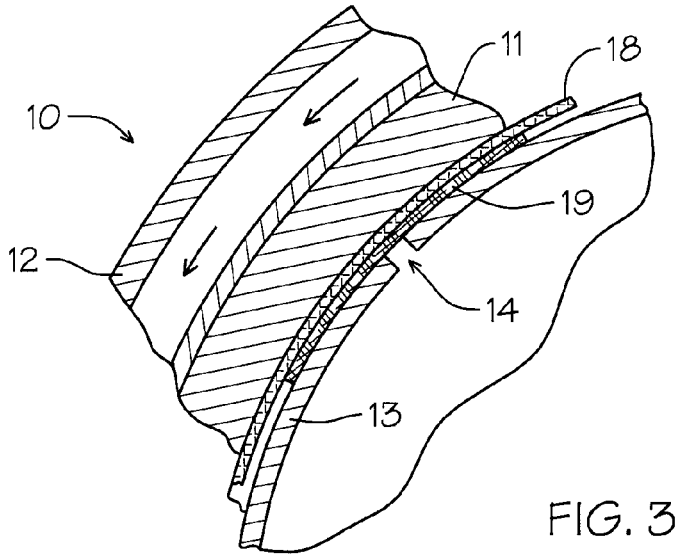
FIG. 3 is an enlarged cross-sectional view of an alternate form of the invention.
Figure 4:
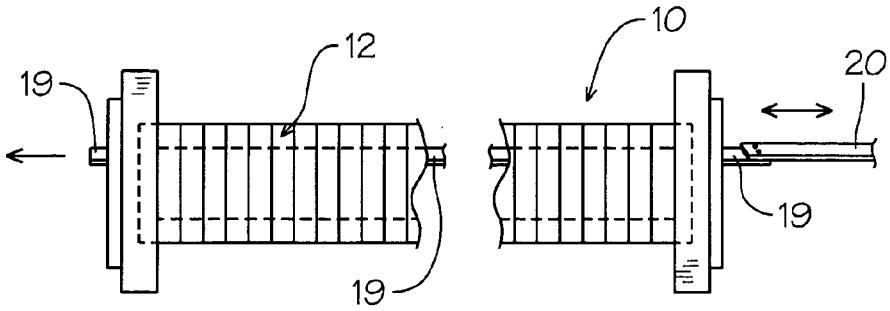
FIG. 4 is an enlarged top plan view of end strips.
Figure 5:
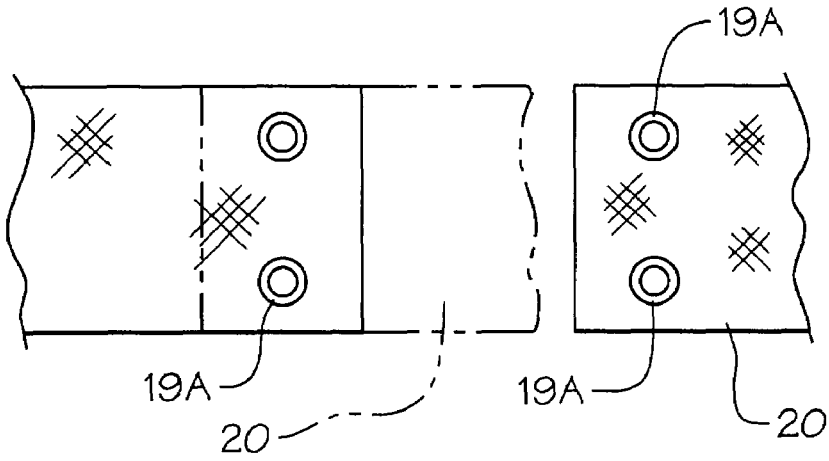
FIG. 5 is a side elevational view of interengaged end strips.
Figure 6:
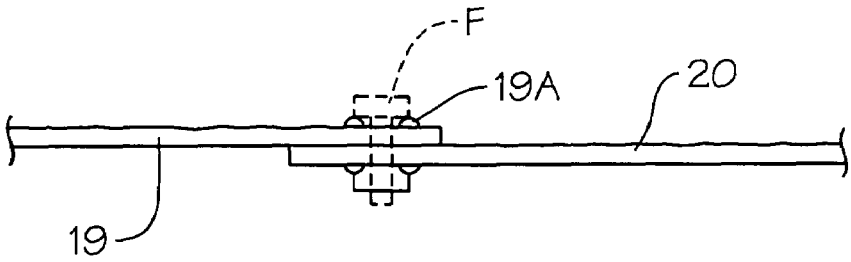
FIG. 6 is an enlarged side elevational view of the interengaged end strips.

Referring now to FIG. 3 of the drawings, an alternate form of the invention can be seen wherein coated grass glass cloth 18 is installed into the interior surface of the coil 11 and then a secondary strip glass cloth material 19 is saturated with the high temperature refractory coating material 17 and let dry. The secondary strip 19 is then positioned in place (gap area) 14 and held temporarily while the stainless steel liner 13 is reinstalled. Mounting and positioning engagement elements 19A (grommets in pairs), best seen in FIGS. 5 and 6 of the drawings on oppositely disposed ends of the strip 19 will allow for future removal and replacement by attaching a replacement strip 20 to the existing strip 19 and simply pulling it out inserting the new strip 20. The cover strip of insulation material 19 is substantially wider than the actual gap area 14 assuring an effective cover application.

The exposed area of the strips 19 or 20 once installed defined by the gap area 14 can also be repaired and maintained by overlying a layer of applied refractory coating material 17 which will extend useful in-service life, if needed, before replacement.

Additionally, the gap area 14 is also subject to thermal cooling due to the open nature of the induction coil and the movement of billets (not shown) in and out in any application of the preferred embodiment set forth previously or the alternate form of the invention as described.

It will be evident from the above description that to prevent premature insulation failure that a multiple layer insulation application process is required in the coil application environment. By use of the preferred embodiment system and materials application with the glass cloth 16 coated with the refractory coating material 19 in combination with the secondary layer or coating of refractory material 17 independently directly into the gap area 14 thereafter, as needed, it will be substantially increasing the operational life of the so treated induction heating coil 11 between extended maintenance cycles.

It will thus be seen that a new and novel method and application for insulation of an induction heating coil has been illustrated and described and it will be evident to those skilled in the art that various changes and modifications may be made thereto without departing from the spirit of the invention.

Therefore I claim:

1. A method and material system to insulate an induction heating coil comprising the steps of:

a. removing an inner stainless steel liner exposing an interior surface of an induction coil winding, b. lining the interior surface of the induction coil winding set forth in step "a" with a glass cloth material, c. coating the exposed surface of the glass cloth with an applicable refractory material of high temperature properties, d. repositioning and securing the steel liner back within the induction heating coil in direct contact with said coated glass cloth liner.

2. The insulation system set forth in claim 1 and wherein step "a" comprises removing existing insulation material from inner surface of the induction coil.

3. The insulation system set forth in claim 1 step "c" wherein said refractory solution comprises a high temperature refractory material bonded to the glass cloth.

4. The insulation system set forth in claim 1 step "c" wherein said applying said refractory material in a viscous spreadable material.

5. The insulation system set forth in claim 1 step "c" further comprises applying a layer of glass cloth over said refractory coil.

6. The insulation system set forth in claim 1 step "b" wherein said glass cloth is formed from textured fiberglass yarn into a woven fabric-like material having a rough textured surface.

7. The insulation system set forth in claim 1 step "c" wherein said refractory coating glass cloth dries into a self-supporting shape retaining characteristics.

8. The insulation system set forth in claim 1 further comprises applying refractory material to a gap area defined by the elongated longitudinal space between respective side edge effacing surfaces of the stainless steel liner.

9. The insulation system set forth in claim 8, step "a" wherein said refractory solution comprises a high temperature refractory material bonded to the glass cloth.

10. The insulation system set forth in claim 8, step "b" wherein securing the end of said respective strips to one another utilizes reinforced aperture fittings in the strips and fasteners removably positioned thereon.

11. The insulation system set forth in claim 8, step "c" requires loosening a stainless steel liner within said induction heating coil replacing said strip and re-tightening said stainless steel liner.

12. The insulation system set forth in claim 8 further comprises coating the exposed area of insulated strip of refractory coated glass cloth within the gap with the refractory coating material filling in the gap there defined.

* * * * *